US005856713A

United States Patent [19]

Huettner et al.

[11] Patent Number: 5,856,713

[45] Date of Patent: Jan. 5, 1999

[54] N-WAY MMIC SWITCH

[75] Inventors: Steven E. Huettner, Billerica; William F. Miccioli, Waltham, both of Mass.

[73] Assignee: Raytheon Company, Lexington, Mass.

[21] Appl. No.: 957,472

[22] Filed: Oct. 24, 1997

[51] Int. Cl.[6] ..... H01P 1/10

[52] U.S. Cl. ..... 307/125; 307/113; 333/101; 333/103; 333/262; 257/275; 327/403

[58] Field of Search ..... 307/125, 113; 333/103, 262, 101; 327/403, 404, 365; 257/275

[56] References Cited

U.S. PATENT DOCUMENTS

| | | | |
|---|---|---|---|
| 4,556,808 | 12/1985 | Coats | 333/262 |
| 4,731,594 | 3/1988 | Kumar | 333/103 |
| 4,897,563 | 1/1990 | Bahl | 307/113 |
| 4,939,485 | 7/1990 | Eisenberg | 333/262 |
| 4,985,689 | 1/1991 | Kadowaki et al. | 333/103 |
| 5,061,911 | 10/1991 | Weidman et al. | 333/262 |

*Primary Examiner*—Albert W. Paladini
*Attorney, Agent, or Firm*—John W. Powell; Glenn H. Lenzen, Jr.

[57] ABSTRACT

A multiple terminal selector switch for use with millimeter-wave signals has a layout of components enabling the switch to be constructed on a monolithic microwave integrated circuit (MMIC) chip while maintaining adequately low cross talk among ports of the switch to retain isolation among its ports. The circuitry includes a transmission line having multiple taps spaced apart by an integral number of half wavelengths of the signal, wherein the taps connect to separate ports via arms of the circuit. Each arm has an electronically switchable element for producing open or short circuits for connection and disconnection of a switch port from the transmission line. One primary tap of the transmission line is unswitched and connects with a further port from which, or to which, signals of the other ports are selectively switched. A driver circuit for control of the switching elements in the respective arms is disposed within a central region of the switching circuit, while the transmission line encircles at least a portion of the driver circuit.

8 Claims, 4 Drawing Sheets

N-WAY MMIC SWITCH

BACKGROUND OF THE INVENTION

This invention relates to the switching of electromagnetic signals of millimeter wavelength and, more particularly, to the construction of a switch of multiple switching arms extending from a multiply-tapped transmission line configured to encircle a driver of the switching arms, thereby providing a switch architecture suitable for construction in a monolithic microwave integrated circuit (MMIC) chip.

Electronic signal processing, such as may be found in radar and in communication systems, may include a switching of signals from one terminal selectively to any one of a multiplicity of terminals. Such switching has been accomplished by mechanical stepping switches and by electronic switching circuits, both of which are physically large as compared to circuit component parts found in MMIC. Of particular interest herein is the capacity to switch millimeter-wave signals by use of circuitry compatible in physical size with an MMIC chip.

A problem arises in that circuitry employed for lower frequency signals is generally too large to fit within the confines of an MMIC chip. Attempts to produce selective, or N-way, switches with multiple output ports, or input ports, has resulted in geometry wherein connecting lines from a common node to the ports (a star configuration) are so close together, in the vicinity of the common node, as to introduce excessive parasitic capacitance which impairs signal transmission, as well as reducing isolation among respective ones of the ports which have been switched off. Attempts to reduce cross talk by cascading several switches, wherein one two-way switch feeds two further two-way switches, results in a circuit layout which is excessively large for MMIC chips, particularly upon inclusion of a suitable driver for the switches.

SUMMARY OF THE INVENTION

The aforementioned problem is overcome and other advantages are provided by a multiple terminal selector switch which, in accordance with the invention, has an architecture conforming to the confines of an MMIC chip, thereby to enable selective switching of millimeter wave signals within signal processing circuitry constructed on an MMIC chip.

The circuitry of the switch comprises a transmission line having multiple nodes serving as taps with arms extending therefrom to connect from the taps to respective ports of the switch. One of the arms serves as a primary arm, and does not have a switch circuit. The other arms are secondary arms. Each of the secondary arms includes switching circuit elements operative electrically by a driver circuit located in a central region of the switch circuitry. In accordance with a feature of the invention, a compact configuration of the switch circuitry is obtained by placing the transmission line adjacent to the drive circuit. In the most compact configuration of the switch circuitry, the drive circuitry is encircled, at least partially by the transmission line, the amount of encirclement depending on the length of the transmission line. Each of the nodes is separated from a neighboring node by an integral number of half wavelengths of a microwave electromagnetic signal applied to the switch. Connection is made between a primary one of the nodes and a selected one of the ports.

Each of the arms comprises one or more active switching elements operative in response to electric signals provided by the driver circuit. In a first embodiment of the switch, each of the active switching elements comprises a diode which is placed in either a state of conduction or nonconduction, the diode being connected within the arm via a segment or stub of a second transmission line to a corresponding node of the first-mentioned transmission line. Each of the transmission line stubs of the respective arms has a length equal to a quarter wavelength of the microwave signal. Thereby, a shorting of the signal port by a conductive state of the shunt diode is reflected back along the line stub to the node of the first transmission line to appear as an open circuit. The shorting of the signal port places the port in a state of being "off", wherein no signal is transmitted via the port. The arm is placed in the "on" state, enabling transmission of a signal via the port, by placing the shunt diode in a state of non-conduction, preferrably by placing a negative bias voltage across the shunt diode to insure that the passage of a relatively strong signal does not place the shunt diode in a state of conduction. In the non-conductive state of the shunt diode, the shunt diode appears to be absent from the circuit (other than for minor parasitic capacitance) and does not impede signal transmission.

In an alternative embodiment of the invention, in each of the arms, the quarter-wave length of transmission line segment is omitted, and there is provided a series field-effect transistor (FET) followed by a shunt FET directly at the port. In each arm, the series FET is placed in a state of conduction concurrently with a state of nonconduction for the shunt FET or, the series FET is placed in a state of nonconduction concurrently with a state of conduction on the shunt FET. This provides for either a coupling or disconnection of signals between the first transmission line and the port depending on the state of the switch.

BRIEF DESCRIPTION OF THE DRAWING

The aforementioned aspects and other features of the invention are explained in the following description, taken in connection with the accompanying drawing figures wherein.

Identically labeled elements appearing in different ones of the figures refer to the same element but may not be referenced in the description for all figures.

DETAILED DESCRIPTION

Figure 1:
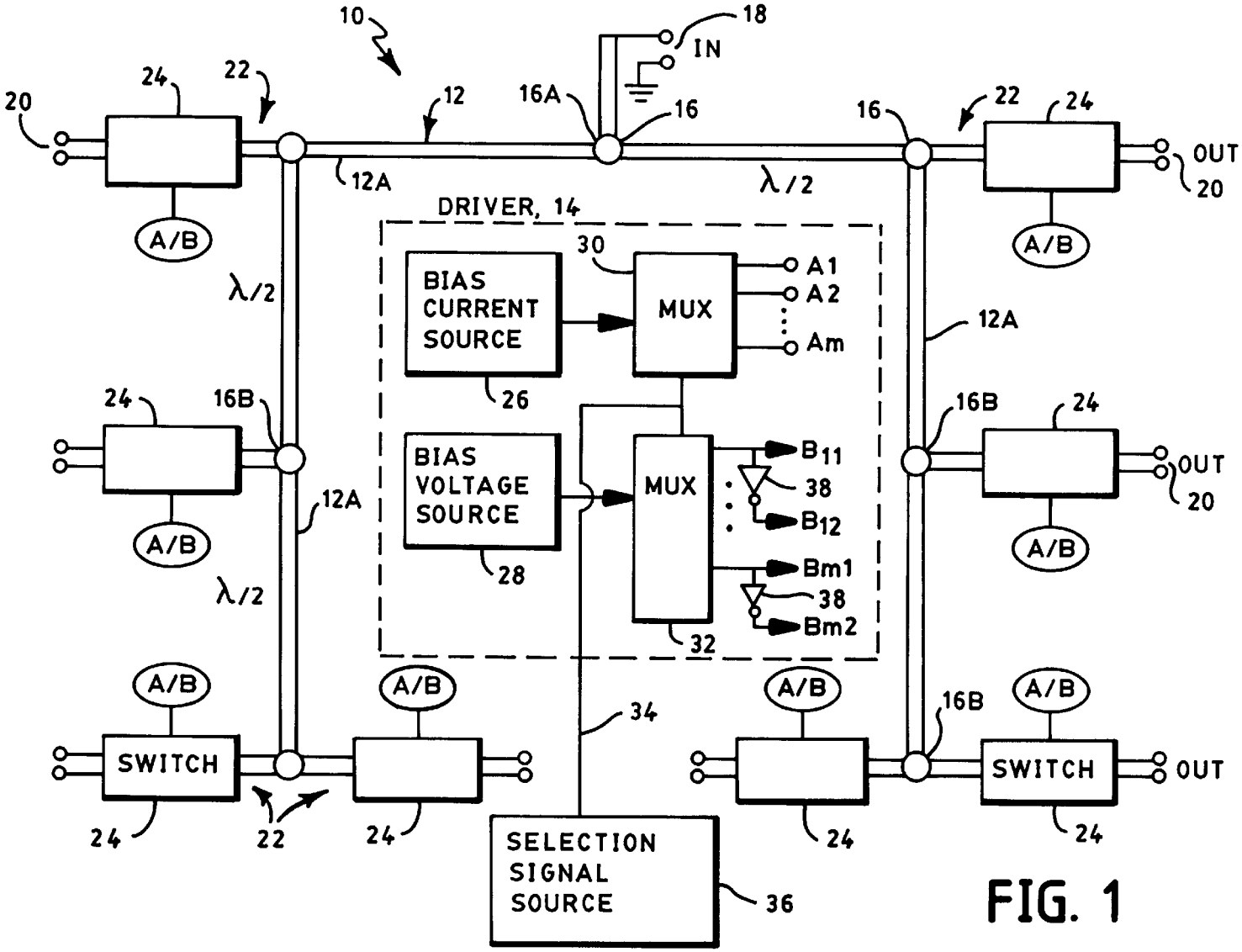
FIG. 1 is a diagrammatic representation of circuitry of the switching circuit of the invention following a layout of components providing an arrangement suitable for fabrication on an MMIC chip.

With reference to FIG. 1, a multiple-terminal switch 10 comprises a transmission line 12 encircling a driver 14. The transmission line 12 has a series of nodes 16 which divides the transmission line 12 into sections 12A. One of the nodes 16, indicated as node 16A, connects with an input port 18. The remaining ones of the nodes 16, indicated as nodes 16B, are connected respectively to multiple output ports 20 via switching arms 22. A signal inputted at node 16A travels via the transmission line 12 to each of the nodes 16B. Thereby, each of the nodes 16B serves as a point at which the input signal can be tapped for transmission, via a respective one of the arms 22, to an output port 20. The circuitry of the switch 10 is operative in reciprocal fashion such that a signal may enter one of the output ports 20 for communication via a respective one of the arms 22 and the transmission line 12 to the input port 18. In view of the reciprocal transmission characteristic of the transmission line 12 and the arms 22, it may be useful to refer to the node 16A as a primary node, and the nodes 16B as secondary nodes. The driver 14 provides drive signals for operating switching circuits 24 located in respective ones of the arms 22.

In the operation of the switch 10, each of the arms 22 presents a high impedance to its corresponding node 16B during a state of disconnection of the port 20 from the node 16B. A relatively low impedance, such as 50 ohms for a 50 ohm system, appears at the node 16B in the case wherein the port 20 is communicating signals with the node 16B. In the construction of the transmission line 12, the nodes 16 are spaced apart from each other by a distance of one-half wavelength (½) of an electromagnetic signal propagating along the transmission line 12. By virtue of the half-wavelength spacing of the nodes 16, an open circuit impedance produced by any one of the arms 22 at a node 16B is reflected back to the node 16A as an open circuit impedance. Thereby, the use of the half-wavelength spacing between the nodes 16 improves transmission of signals from the input port 18 to any one of the output ports 20.

Figure 2:
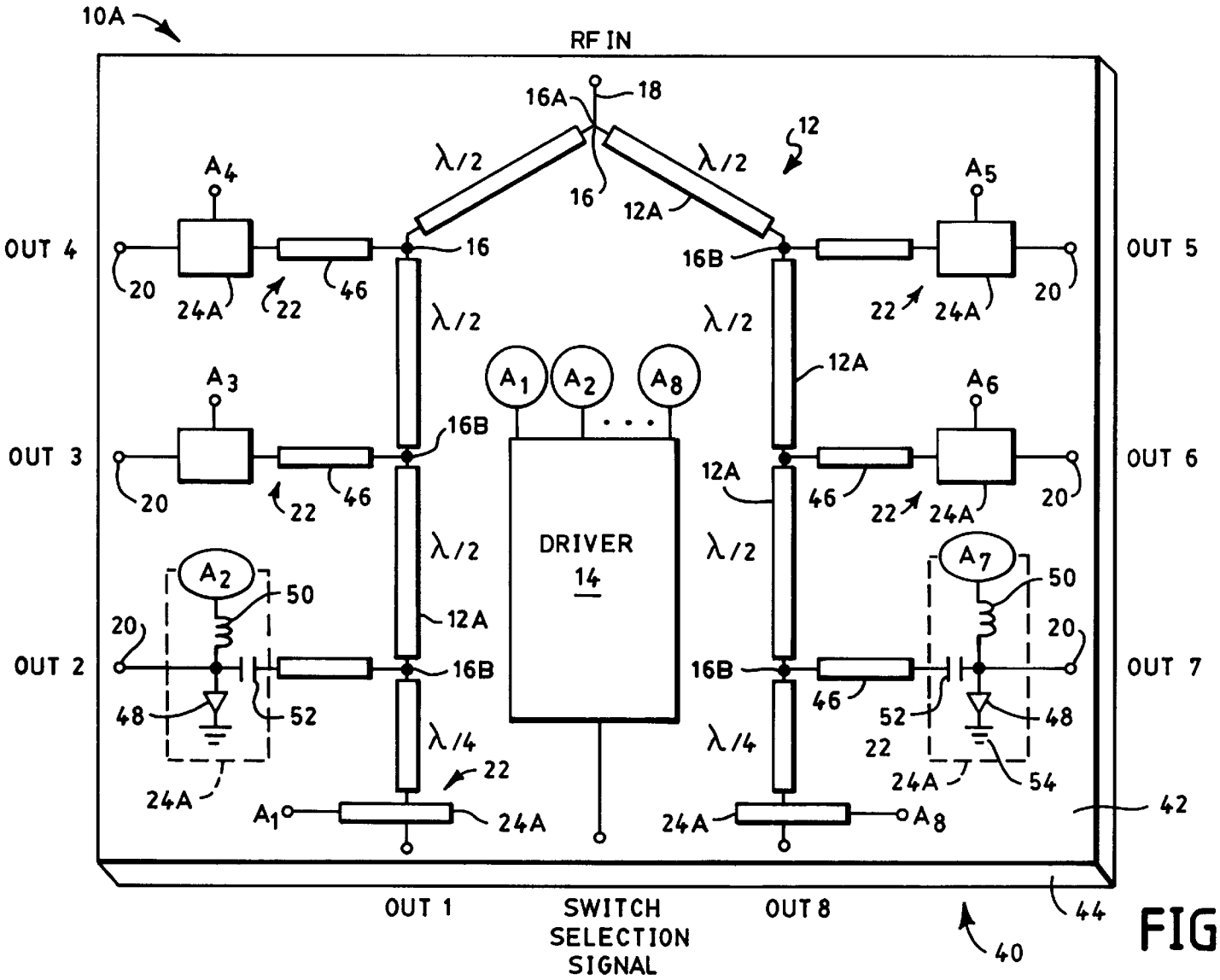
FIG. 2 is a schematic drawing showing details of the circuitry of FIG. 1 in accordance with a first embodiment of the invention.
Figure 3:
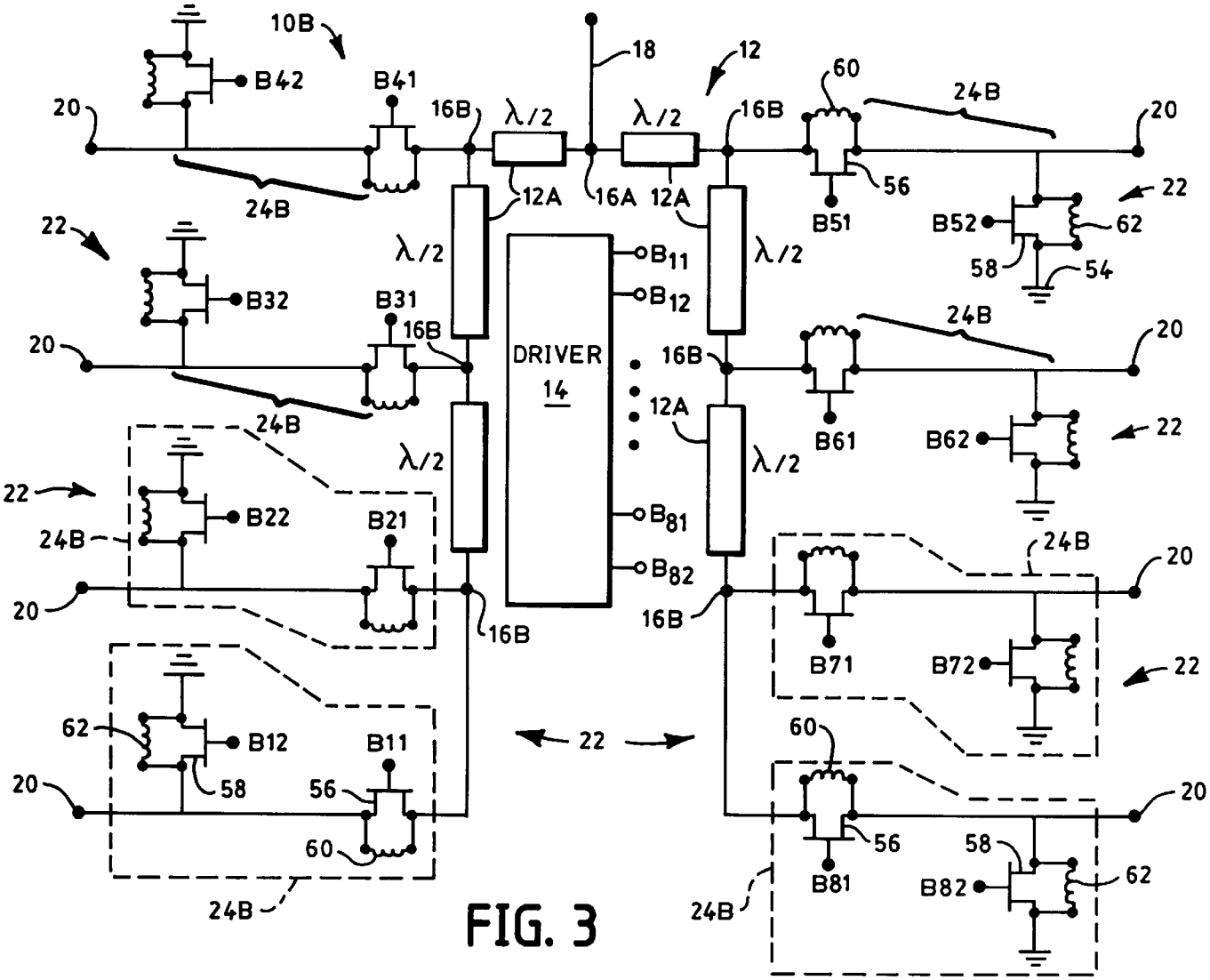
FIG. 3 is a schematic drawing showing details of the circuitry of FIG. 1 in accordance with a second embodiment of the invention.

Two forms of construction of the switching circuit 24 may be employed in the practice of the invention, namely, the construction of the switching circuit 24 in accordance with the embodiment of FIG. 2 wherein a diode is employed as an active switching element, and the embodiment of FIG. 3 wherein a combination of series and parallel FETs is employed as the active switching element. Each of these embodiments requires a form of bias signal which is different from that of the other embodiment for placing the respective active element in a state of conduction and nonconduction. As will be described hereinafter with reference to FIGS. 2 and 3, the diode of FIG. 2 requires a bias current, while each of the pairs of FETs requires complementary voltage bias signals.

In order to simplify the description, the driver 14 of FIG. 1 is shown in generic form as having the capability of providing both types of bias signals, so as to enable the single driver circuit 14 to be employed in either one of the circuits of FIGS. 2 and 3. In practice, the driver 14 would be constructed usually with only the capability of providing one type of bias signal. The driver 14 comprises a bias current source 26 and a bias voltage source 28, and two multiplexers 30 and 32 connected to respective ones of the sources 26 and 28. Each of the multiplexers 30 and 32 is operative in response to an address on line 34 which designates the specific one of the switching circuits 24 to be activated. The address signal on line 34 is provided by means of a selection signal source 36.

Thereby, for operation with the embodiment shown in FIG. 2, the bias current source 26 provides bias currents via the multiplexer 30 to the arms 22. The output terminals of the multiplexer 30 are identified as A1 to An. A bias voltage from the source 28 is coupled by the multiplexer 32 to a respective one of the arms 22 in the embodiment of FIG. 3. Since complementary bias voltages are provided for the embodiment of FIG. 3, inverters 38 are employed with each of the terminals, such as the terminal B11 to provide a complementary voltage at the terminal B12. Thereby, pairs of complementary voltages are provided at each of the terminal pairs B11, B12 through Bn1, Bn2. In FIG. 1, the terminals of the respective switching circuits 24 are identified by the legend A/B so that the switching circuit 24 is understood to apply generally to either one of the embodiments of FIGS. 2 and 3.

With reference to FIG. 2, there is shown a switch 10A constructed in accordance with a first embodiment of the invention. The switch 10A comprises the transmission line 12 and the driver 14 which are fabricated in accordance with photolithographic techniques employing semiconductor material on an MMIC chip 40. Both the transmission line 12 and the driver 14 are located on a front surface 42 of a substrate 44 of the chip 40. Each of the arms 22 comprises a quarter-wavelength stub line and a switching circuit 24A constructed in accordance with the first embodiment of the invention. Output terminals A1–A8 of the driver 14 connect with respective ones of the control terminals A1–A8 of the switching circuits 24A.

By way of example in the construction of the invention, the number, n, of the arms 22 is eight, it being understood that other numbers of the arms 22 may be employed. In each of the arms 22, the switching circuit 24A connects via the quarter-wavelength transmission line stub 46 to a node 16B. Each of the switching circuits 24A comprises a diode 48, such as a PIN diode, an inductor 50, and a capacitor 52. The diode 48 connects between the output port 20 and ground 54. The inductor 50 connects between the output port 20 and a terminal A of the driver 14. The capacitor 52 connects between output port 20 to the line stub 46. The driver 14, via a respective one of the terminals A1–A8 provides direct current (DC) to the respective switching circuit 24A and, within the switching circuit 24A, via the inductor 50 to the diode 48 for biasing the diode 48 into a state of conduction. Discontinuance of the bias current by the driver 14 places the diode 48 into a state of nonconduction. The input signal at input port 18 is at radio-frequency (RF) typically in the millimeter wave region of the spectrum, and the inductor 50 serves to isolate the driver 14 from RF signals present at the arm 22. The capacitor 52 serves to block the DC bias current from the transmission line 12 while allowing for propagation of the RF signal from the node 16B via the line stub 46 to the output port 20.

In operation, the driver 14 places the diode 48 in a state of conduction and essentially shorts out the port 20 by application of bias current to the diode 48. Alternatively, the driver 14 terminates the bias current placing the diode 48 in a state of relatively large impedance. The amplitude of an RF signal propagating through the capacitor 52 may be smaller than the forward conduction threshold of the diode 48 so as not to place the diode 48 in a state of conduction when the driver 14 is commanding a state of nonconduction. In contrast, an RF signal of relatively high amplitude may place the diode 48 in a state of conduction. To prevent the relatively large-amplitude RF signal from placing the diode 48 in a state of conduction, the driver 14 applies a negative bias voltage, typically 10 volts, across the diode 48 at such times wherein the diode 48 is to be in a state of nonconduction.

A state of conduction in the diode 48 with its consequent shorting of the arm 22 reflects the signal back to the transmission line 12, and prevents its exiting the port 20. The short circuit is reflected back via the line stub 46 to appear as an open circuit at terminal 16B to the transmission line 12. Accordingly, an RF signal does not propagate from the transmission line 12 into the arm 22. In the state of nonconduction of the diode 48, the diode 48 no longer loads the transmission line, thereby enabling signal energy to pass freely through the line stub 46 to any load which may be connected to the port 20 at the end of the line stub 46. This provides a conductive path from the node 16B into the arm 22 for communication with the output port 20. In this way, one or more of the output ports 20 can be selected by the driver 14 to communicate with the input port 18.

As shown by the arrangement of the components of the switch 10A in FIG. 2, all of the components, including the switching circuits 24A, the line stubs 46, the transmission line 12 and the driver 14 can be located on one side of the chip 40. In the arrangement, there is almost complete encirclement of the driver 14 by the half-wavelength sections 12A of the transmission line 12. By folding the transmission line 12 about the driver 14, additional space on the chip 40 is made available for construction of the arms 22 on the front surface 42. It is noted also that, at each of the nodes 16, the number of transmission line sections extending from each of the nodes 16 is limited to three transmission line segments. This configuration avoids a crowding of transmission lines about a common node, as would occur in a star-configuration of multiple terminal switch. By way of example, if the switch 10A were to be constructed with a star configuration wherein the node 16A would be at the center of the configuration, there would be a total of eight arms 22 extending from the single node with a consequential excessive capacitance at the single node, due to the loading of the node with each of the transmission line sections, and with a consequential cross talk among the transmission line sections of each of the arms 22. Such a situation is avoided by the arrangement of the invention, as shown in FIG. 2, wherein the total loading of any one of the nodes 16 is limited to only three transmission line sections.

Furthermore, a line stub 46 is spaced apart from a transmission line section 12A by an angle of 90° or more. Also, one or more additional transmission-line sections 12A may be added to the transmission line 12 or deleted from the transmission line 12 without introducing a situation of crowding at any one of the nodes 16. Thereby, the configuration of the components of the switch 10A allows for expansion or contraction in the number of the output ports while enabling construction of the entire switch on one surface of an MMIC chip. The circuitry of FIG. 2 can be constructed on a square chip measuring less than 0.1 inch by 0.1 inch. The same advantages of construction are found also in the second embodiment of the invention disclosed in FIG. 3.

In FIG. 3, the second embodiment of the invention has the driver 14 encircled by the transmission line 12. As shown in FIGS. 1–3, the transmission line 12 has six sections 12A partially enclosing the driver 14, and interconnecting eight output ports 20 with input port 18. In FIG. 3, each of the arms 22 comprises a switching circuit 24B constructed in accordance with the second embodiment of the invention. In each of the arms 22, the switching circuit 24B comprises a series FET 56 and a shunt FET 58 which are bypassed by inductors 60 and 62, respectively. In any one of the switching units 24B, the series FET 56 is placed in a state of conduction for connecting an output port 20 to the corresponding node 16B. Placing the series FET 56 in a state of nonconduction disconnects the output port 20 from the node 16B. Each of the FETs 56 and 58 is constructed as a 0.5 micron MESFET having capacitance between the source and the drain electrodes. At millimeter wave RF signals, the parasitic capacitance of the FET 56 is much higher than the parasitic capacitance of the diode 48 of FIG. 2, possibly by an order of magnitude, and is sufficiently high to provide excessively high conductance of signals between the node 16B and the port 20 even in the case wherein the series FET 56 is in a state of nonconduction. The inductor 60 is employed to resonate with the parasitic capacitance of the FET 56 with the result that the parallel resonance of the inductor 60 with the FET capacitance results in a high impedance, limited by the value of the source-to-drain resistance of the FET 56 in its state of nonconduction.

In the state of nonconduction of the FET 56, the combination of the series FET 56 with its inductor 60 is, therefore, operative to disconnect the node 16B from the port 20 at the resonant frequency which is the carrier frequency of the RF signal. Still further isolation between the node 16B and the port 20 is obtained by placing the shunt FET 58 in a state of conduction concurrently with the state of nonconduction in the FET 56. Thereby, the FET 58 acts as a shunt to ground for any low-level signal which may pass through the series FET 56. The inductor 62 resonates with capacitance of the shunt FET 58 via a parallel resonance which cancels the effect of the capacitance at the resonant frequency, which resonant frequency is the carrier frequency of the RF signal. The signal propagating from the node 16B to the output port 20 is attenuated by the ratio of the shunt resistance of the FET 58 to the series resistance of the FET 56 under conditions wherein the series FET 56 is in a state of nonconduction and the shunt FET 58 is in a state of conduction. During a state of conduction of the series FET 56, the resistance of the nonconducting shunt FET 58, in combination with the parallel resonance of its capacitance and the inductance of its inductor 62, offer essentially no attenuation of the signal propagating through the arm 22.

With respect to driving respective ones of the FETs 56 and 58 within respective ones of the switching circuits 24B, signals outputted by the driver 14 at terminals B11, B21, B31 . . . B81 are applied to the gate terminals of corresponding ones of the series FETs 56. Concurrently with the application of the drive signals to the series FETs 56, the driver 14 outputs drive signals via the terminals B12, B22, B32 . . . B82 to gate terminals of corresponding ones of the shunt FETs 58 in the respective switching circuits 24B. As noted hereinabove, the drive signals for the series and the shunt FETs in each of the switching circuits 24B are complementary with the result that the series FET 56 and the shunt FET 58 are placed in opposite states of conduction and nonconduction. The circuitry of FIG. 3 can be constructed on a square chip measuring 0.08 inches (2,000 microns) on a side.

Figure 4:
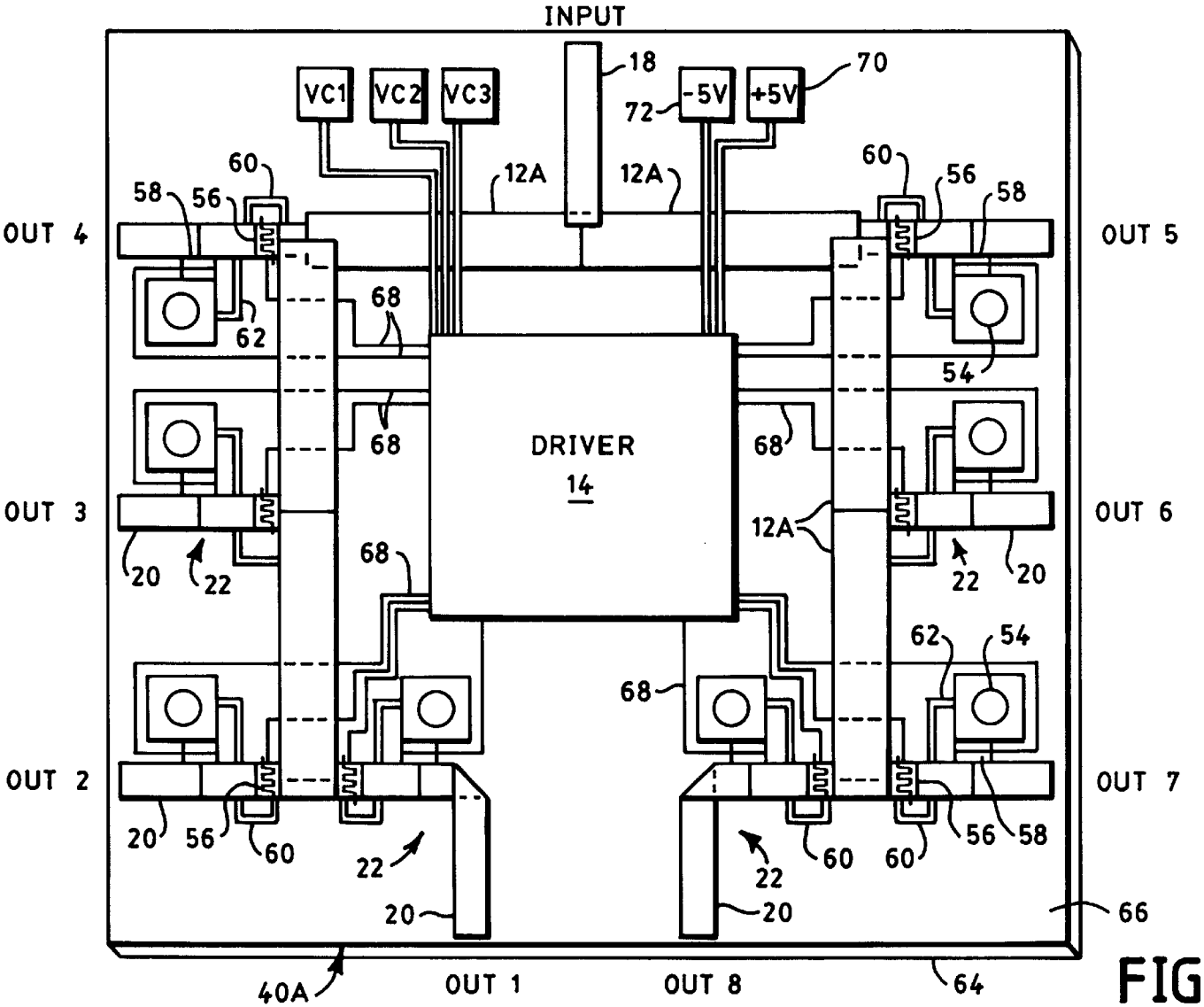
FIG. 4 is a layout in accordance with the second embodiment of the invention showing locations of components on an MMIC chip.

In FIG. 4, there is shown an MMIC chip 40A with the circuitry of FIG. 3 placed thereon by photolithographic techniques. Various elements of the circuitry of FIG. 3 are shown n FIG. 4, namely, the driver 14, the transmission line sections 12A, the FETs 56 and 58, and the inductors 60 and 62 within the various arms 22, all of which are located on the front surface 66 of the chip 40A. Ground 54 is provided by vias having a circular cross section, and connecting with a ground plane 64 located behind the front surface 66. Also shown in FIG. 4 are the input port 18 and the output ports 20. Connecting electrical conductive strips 68 interconnect output terminals of the driver 14 with the gate terminals of the FETs 56 and 58 of the respective arms 22. The conductive strips 68 cross over various ones of the transmission line sections 12A by means of air bridges (not shown). By way of example, an air bridge may be constructed, if desired, by placing an insulating layer (not shown) upon a transmission line section 12A and then depositing the conductive strip 68 upon the layer. Also shown in FIG. 4 are terminals 70 and 72 for supplying operating voltages to the driver 14, as well as other terminals VC1, VC2, and VC3 for supplying control signals to the driver 14. It is noted that the chip 40A is somewhat smaller than the chip 40 (FIG. 2) because the inductors 50 for the bias current, and the higher power dissipation within the diodes 48 and the transmission line stubs 46 necessitate a somewhat larger configuration of chip architecture in order to fit all of the circuit components. Both embodiments of the switch 10, in accordance with the invention, can be constructed on an MMIC chip.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A multiple-terminal selector switch having an architecture conforming to a monolithic microwave integrated circuit (MMIC) chip, the switch comprising:

a transmission line having multiple nodes, any one of said nodes being separated from a neighboring one of said nodes by a spacing equal to an integral number of half-wavelengths of a microwave signal applied to the switch, one of said nodes being a primary node, and the other of said nodes being a secondary node;

a plurality of switching arms connected to respective ones of said secondary nodes, each of said switching arms having a signal port distant from said transmission line;

a driver for controlling each of said switching arms for establishing states of conduction and nonconduction in each of said switching arms, said transmission line having a configuration which at least partially encloses said driver;

wherein said transmission line and said driver are disposed on a front surface of said chip; and a state of conduction in any one of said switching arms enables conduction of a signal between the port of said one switching arm and said primary node via said transmission line.

2. A switch according to claim 1 wherein each of said switching arms is located on said front surface of said chip.

3. A switch according to claim 1 wherein said transmission line is a first transmission line, and each of a plurality of said switching arms comprises a shunt switching means, and a segment of a second transmission line, the segment having a length of an odd number of one-quarter wavelengths; and wherein, in each of said plurality of arms, said transmission line segment connects said signal port to said first transmission line, and said shunt switching means grounds said signal port upon a placing of said shunt switching means in a state of conduction by said driver.

4. A switch according to claim 3 wherein said shunt switching means, comprises a diode and a bias circuit interconnecting said driver with said diode.

5. A switch according to claim 1 wherein each of a plurality of said switching arms comprises a series switching element and a shunt switching element; and wherein, in each of said plurality of arms, said series switching element connects said signal port to said transmission line upon a placing of said series switching element in a state of conduction by said driver, and said shunt switching element grounds said signal port upon a placing of said shunt switching element in a state of conduction by said driver.

6. A switch according to claim 5 wherein, with respect to any one of said plurality of switching arms, said driver is operative to place said series switching element in a state of nonconduction concurrently with a placing of said shunt switching element in a state of conduction.

7. A switch according to claim 6 wherein, with respect to any one of said plurality of switching arms, each of said switching elements comprises a field effect transistor (FET).

8. A switch according to claim 7 wherein, with respect to any one of said plurality of switching arms, said arm comprises a first inductor and a second inductor connected in parallel, respectively, with said series FET and said shunt FET for resonating with capacitances of the respective ones of said FETs.

* * * * *